US012239208B2

(12) United States Patent
Akamatsu

(10) Patent No.: US 12,239,208 B2
(45) Date of Patent: Mar. 4, 2025

(54) ROD-SHAPED COSMETIC

(71) Applicant: TOKIWA CORPORATION, Gifu (JP)

(72) Inventor: Yoshinori Akamatsu, Saitama (JP)

(73) Assignee: TOKIWA CORPORATION, Gifu (JP)

( * ) Notice: Subject to any disclaimer, the term of this patent is extended or adjusted under 35 U.S.C. 154(b) by 0 days.

(21) Appl. No.: 18/241,514

(22) Filed: Sep. 1, 2023

(65) Prior Publication Data

US 2024/0081509 A1 Mar. 14, 2024

(30) Foreign Application Priority Data

Sep. 9, 2022 (JP) ..... 2022-143813

(51) Int. Cl.
*A45D 40/20* (2006.01)

(52) U.S. Cl.
CPC ..... *A45D 40/20* (2013.01); *A45D 2200/10* (2013.01); *A45D 2200/1072* (2013.01)

(58) Field of Classification Search
CPC ..... A45D 40/20; A45D 40/00; A45D 2040/0012; A45D 2040/0025; A45D 2200/10; A45D 2200/1072
USPC ..... 401/6, 9, 11, 34, 35, 49
See application file for complete search history.

(56) References Cited

U.S. PATENT DOCUMENTS

| | | | | | |
|---|---|---|---|---|---|
| 1,320,855 | A * | 11/1919 | Henderson | A61K 8/31 | 424/DIG. 5 |
| 2,344,883 | A * | 3/1944 | Kairalla | A45D 40/02 | 118/76 |
| 4,291,018 | A * | 9/1981 | Oeda | A61Q 1/06 | 401/35 |
| 6,203,807 | B1 * | 3/2001 | Lemann | A61Q 3/02 | 424/653 |
| 8,376,641 | B2 * | 2/2013 | Fraillon | A45D 40/20 | 401/19 |
| 8,523,470 | B2 * | 9/2013 | Palo | A45D 40/20 | 401/35 |
| 11,980,779 | B2 * | 5/2024 | Costo Lucco | A61K 8/0229 | |

FOREIGN PATENT DOCUMENTS

| | | |
|---|---|---|
| JP | 2012-235885 | 12/2012 |
| JP | 2022-119019 | 8/2022 |

* cited by examiner

*Primary Examiner* — David J Walczak
(74) *Attorney, Agent, or Firm* — GREENBLUM & BERNSTEIN, P.L.C.

(57) ABSTRACT

A rod-shaped cosmetic includes a rod-shaped main body part composed of a cosmetic composition, and a cavity part extending in the longitudinal direction of the rod-shaped main body part and opening at one end or at both ends of the rod-shaped main body part is provided inside the rod-shaped main body part.

19 Claims, 8 Drawing Sheets

ROD-SHAPED COSMETIC

TECHNICAL FIELD

The present invention relates to a rod-shaped cosmetic.

BACKGROUND

Rod-shaped cosmetics are used as core materials for eyebrow pencils and the like (see, for example, Japanese Unexamined Patent Publication No. 2012-235885 and Japanese Unexamined Patent Publication No. 2022-119019). Recently, eyebrow pencils having a core material with a diameter of 1 mm or less are also utilized.

SUMMARY

When a rod-shaped cosmetic is made thinner, as the usability is improved, such as making the eyebrows less likely to lie down, and the ease of drawing such as smooth application capability is improved, it is easier to draw the eyebrows so as to add hair one by one, it is difficult to adjust the shade, and the cosmetic tends to break or bend easily when subjected to impacts and the like.

The present invention was achieved in view of such circumstances, and it is an object of the invention to provide a rod-shaped cosmetic that enables usability and ease of drawing to be compatible with ease of shade adjustment, impact resistance, and strength.

A rod-shaped cosmetic according to an aspect of the present invention includes a rod-shaped main body part composed of a cosmetic composition, and inside the rod-shaped main body part, a cavity part extending in a longitudinal direction of the rod-shaped main body part and opening at one end or at both ends of the rod-shaped main body part is provided.

According to the above-described rod-shaped cosmetic, usability and ease of drawing can become compatible with ease of shade adjustment, impact resistance, and strength. Regarding the reasons for obtaining such an effect, it is considered with regard to the rod-shaped main body part having a cavity part that in comparison with a case where a cavity part is not provided, as the proportion of the transverse cross-sectional area (area serving as a surface of application) of the rod-shaped main body part with respect to the outer diameter (for example, maximum diameter) of the rod-shaped main body part becomes smaller, while the mechanical strength is secured, the rod-shaped cosmetic can be smoothly applied while combing the eyebrows by means of a narrow surface of application, and in addition, since a moderate outer diameter can be secured, a moderate sensation of gradation can be rendered.

Furthermore, the above-described rod-shaped cosmetic is also excellent from the viewpoint of the ease of corner drawing, since the proportion of the length of the outer periphery (that is, length of forming a corner) with respect to the transverse cross-sectional area of the rod-shaped main body part becomes larger. Furthermore, when the above-described rod-shaped cosmetic is used as an eyebrow pencil, the rod-shaped cosmetic can be applied while combing the eyebrows by a cavity part or a recessed part, and makeup can be applied without causing the eyebrows to lie down (without collapsing).

With regard to the rod-shaped cosmetic according to the above-described aspect, from the viewpoint of obtaining smooth application properties, the cosmetic composition may include a volatile component. When a cosmetic composition including a volatile component is applied on the eyebrows, the eyebrows tend to easily lie down; however, according to the rod-shaped cosmetic related to the above-described one aspect, since the rod-shaped cosmetic can be applied while combing the eyebrows, smooth application properties and excellent usability such as that makeup can be applied without causing the eyebrows to lie down (without collapsing), can be achieved in a balanced manner.

With regard to the rod-shaped cosmetic according to the above-described aspect, from the viewpoint of the ease of manufacture, the cavity part may be cylindrically shaped.

A rod-shaped cosmetic according to another aspect of the present invention includes a rod-shaped main body part composed of a cosmetic composition, and a recessed part extending in a longitudinal direction of the rod-shaped main body part and opening in one direction perpendicular to the longitudinal direction is provided on a side face of the rod-shaped main body part so as to reach one end or both ends of the rod-shaped main body part.

According to the above-described rod-shaped cosmetic, usability and ease of drawing can become compatible with ease of shade adjustment, impact resistance, and strength. Regarding the reasons for obtaining such an effect, it is considered with regard to the rod-shaped main body part having a recessed part that in comparison with a case where the rod-shaped main body part does not have a recessed part, as the proportion of the transverse cross-sectional area (area serving as a surface of application) of the rod-shaped main body part with respect to the outer diameter (for example, maximum diameter) of the rod-shaped main body part becomes smaller and as the mechanical strength is increased by the side walls of the recessed part, while the mechanical strength is secured, the rod-shaped cosmetic can be smoothly applied while combing the eyebrows by means of a narrow surface of application, and in addition, since a moderate outer diameter can be secured, a moderate sensation of gradation can be rendered.

With regard to the rod-shaped cosmetic according to the other aspect, from the viewpoint of obtaining smooth application properties, the cosmetic composition may include a volatile component. In this case, smooth application properties and excellent usability such as that makeup can be applied without causing the eyebrows to lie down (without collapsing), can be achieved in a balanced manner.

With regard to the rod-shaped cosmetic according to the other aspect, the rod-shaped main body part may have a shape in which a recessed part is provided in the flat side face of a rod-shaped object having a semicircular cylindrical shape, and the inner face of the recessed part in a cross-section orthogonally intersecting the longitudinal direction of the rod-shaped object may have a semicircular shape. In this case, as the shape of the outer face of the rod-shaped main body part and the inner face of the recessed part is a semicircular cylindrical shape, usability such as that makeup can be applied without causing the eyebrows to lie down (without collapsing) is likely to be obtained.

According to the present invention, a rod-shaped cosmetic that enables usability and ease of drawing to be compatible with ease of shade adjustment, impact resistance, and strength can be provided.

DETAILED DESCRIPTION

In the following description, embodiments of the rod-shaped cosmetic according to the present invention will be described with reference to the drawings.

First Embodiment

A rod-shaped cosmetic according to a first embodiment includes a rod-shaped main body part composed of a cosmetic composition, and a cavity part extending in the longitudinal direction of the rod-shaped main body part and opening at one end or at both ends of the rod-shaped main body part is provided inside the rod-shaped main body part.

Figure 1:
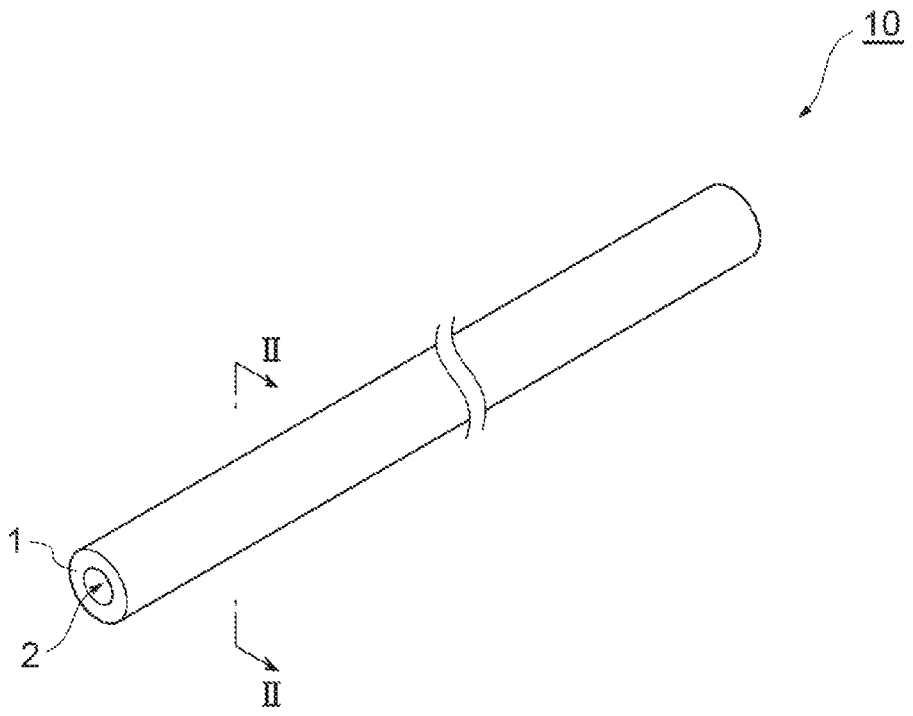
FIG. 1 is a perspective view illustrating an example of a rod-shaped cosmetic according to a first embodiment.

FIG. 1 is a perspective view showing an example of the rod-shaped cosmetic according to the first embodiment. The rod-shaped cosmetic 10 shown in FIG. 1 includes a rod-shaped main body part 1 composed of a cosmetic composition, and a cavity part 2 extending in the longitudinal direction (major axis direction) of the rod-shaped main body part and opening at one end of the rod-shaped main body part is provided inside the rod-shaped main body part 1. Furthermore, the rod-shaped cosmetic 10 is such that the external form of the rod-shaped main body part 1 and the cavity part 2 are cylindrically shaped, and the central axis lines of the cylinders overlap each other.

Figure 2:
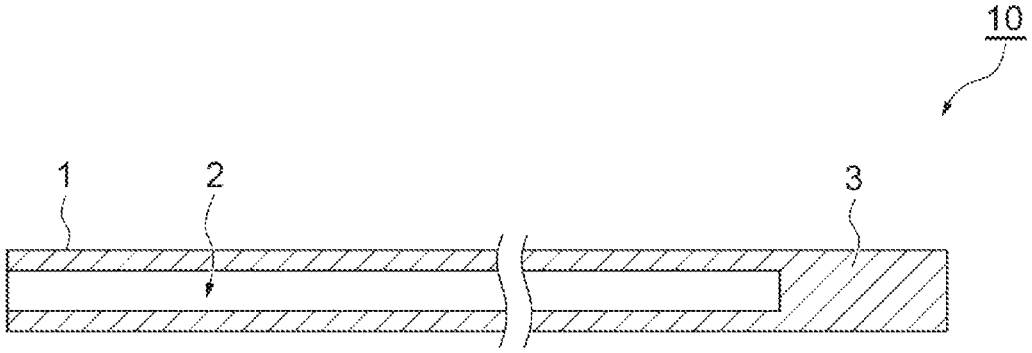
FIG. 2 is a cross-sectional view taken along line II-II in FIG. 1.

FIG. 2 is a cross-sectional view taken along line II-II in FIG. 1. As shown in FIG. 2, in the rod-shaped cosmetic 10, the rod-shaped main body part has an area 3 without a cavity part. This area 3 can be used as a holding part in which the rod-shaped cosmetic is held, for example, when the rod-shaped cosmetic is accommodated in a container having a feeding mechanism that continuously feeds out the rod-shaped cosmetic in the axial line direction. The length of the area 3 can be appropriately set according to the container accommodating the rod-shaped cosmetic; however, from the viewpoint of impact resistance, the length may be 5% to 40%, or may be 10% to 30%, with respect to the total length of the rod-shaped main body part. In the rod-shaped cosmetic 10, the length of the rod-shaped main body part 1 may be 15 to 100 mm, 20 to 50 mm, or 25 to 40 mm, from the viewpoints of portability and the number of times of use.

Figure 3:
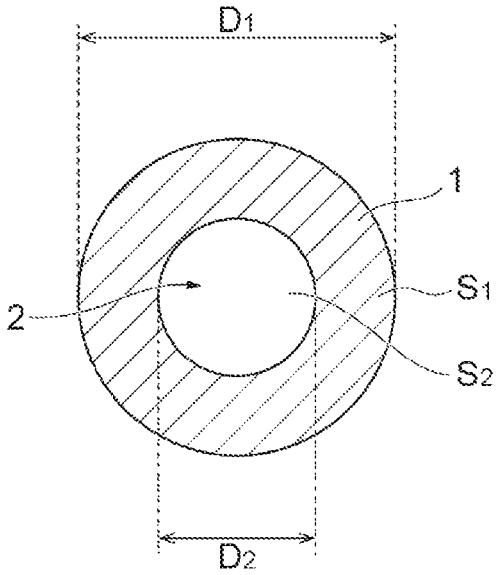
FIG. 3 is a diagram showing a transverse cross-section of the rod-shaped cosmetic shown in FIG. 1.

FIG. 3 is a diagram showing a transverse cross-section of the rod-shaped main body part 1 provided with a cavity part 2 in the rod-shaped cosmetic 10. In the rod-shaped cosmetic 10, a cylindrical rod-shaped main body part 1 is provided with a cylindrical-shaped cavity part 2 such that their central axes overlap each other, and thereby the thickness of the rod-shaped main body part 1 can be made thin and constant.

The diameter $D_1$ of the external form of the rod-shaped main body part 1 may be 1 to 10 mm, 1.5 to 4.0 mm, or 2.0 to 3.0 mm, from the viewpoint of achieving impact resistance, strength, and the ease of manufacture in a balanced manner.

The diameter $D_2$ of the cavity part 2, which is also the diameter of the internal form of the rod-shaped main body part 1, may be 0.1 to 4.0 mm, 0.5 to 3.0 mm, or 1.0 to 2.0 mm, from the viewpoints of smoothness, the ease of shade adjustment, and the ease of eyebrow combing.

The thickness of the rod-shaped main body part 1 can be set to 0.2 to 5 mm, 0.25 to 2.0 mm, or 0.3 to 1.5 mm, from the viewpoints of the ease of shading, the ease of manufacture, and breaking strength. Incidentally, with regard to the rod-shaped cosmetic according to the first embodiment, the thickness of the rod-shaped main body part means the shortest distance connecting the side face on the outer side and the side face on the inner side. In the case of the rod-shaped main body part 1, the main body part has a constant thickness. $D_1$ and $D_2$ can be set such that the thickness of the rod-shaped main body part 1 is in the above-described range, and $(D_1-D_2)/2$ may satisfy the above-described range.

With regard to the rod-shaped cosmetic 10, from the viewpoint of the ease of shading, the ratio $S_1/S_2$ between the transverse cross-sectional area $S_1$ of the rod-shaped main body part 1 and the transverse cross-sectional area $S_2$ of the cavity part 2 may be 0.5 to 3.5, 1.0 to 3.0, or 1.5 to 2.5.

With regard to the rod-shaped cosmetic according to the first embodiment, the external form of the rod-shaped main body part may be, as the shape of the transverse cross-section, a circle, an ellipse, a star shape, a fan shape, a triangle, a square, a rectangle, a polygon (having a number of corners of 5 or more) such as a hexagon, or a flat shape, the shape of the cavity part may be, as the shape of the transverse cross-section, a circle, an ellipse, a star shape, a fan shape, a triangle, a square, a rectangle, a polygon (having a number of corners of 5 or more), or their flat shape, and these can be appropriately combined.

With regard to the rod-shaped cosmetic according to the first embodiment, the cavity part may be disposed at the center (central part) of the external form of the rod-shaped main body part or may be disposed away from the center (central part).

From the viewpoint of the ease of shading, each of the external form and the internal form (shape of the cavity part) of the rod-shaped main body part may be point-symmetric with respect to the central axis line, or the central axis lines may overlap each other.

Each of the external form and the internal form of the rod-shaped main body part may have a cylindrical shape, a quadrangle, a pentagon, or a hexagon from the viewpoint of the ease of shading, and both of them may have the same shape (particularly, a cylindrical shape or a polygon) from the viewpoint of the ease of drawing.

Figure 4A:
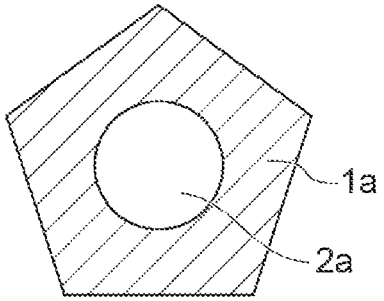
FIGS. 4A to 4D are diagrams showing transverse cross-sections of another example of the rod-shaped cosmetic according to the first embodiment.
Figure 4B:
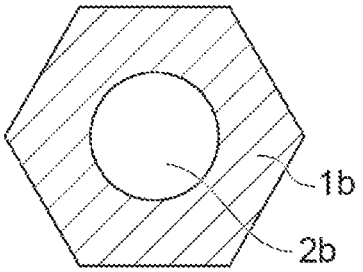
Figure 4C:
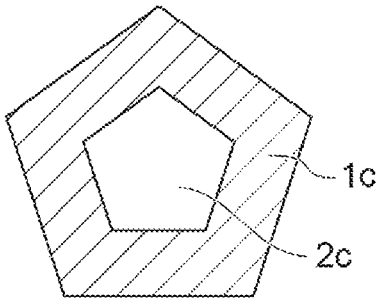
Figure 4D:
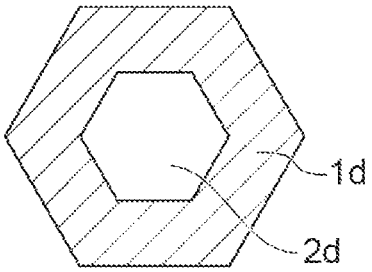

FIGS. 4A to 4D are diagrams showing transverse cross-sections of another example of the rod-shaped cosmetic according to the first embodiment. FIG. 4A shows a transverse cross-section of a rod-shaped cosmetic including a rod-shaped main body part 1*a* having a pentagonal prism-shaped external form and a cylindrical-shaped cavity part 2*a*; FIG. 4B shows a transverse cross-section of a rod-shaped cosmetic including a rod-shaped main body part 1*b* having a hexagonal prism-shaped external form and a cylindrical-shaped cavity part 2*b*; FIG. 4C shows a transverse cross-section of a rod-shaped cosmetic including a rod-shaped main body part 1*c* having a pentagonal prism-shaped external form and a pentagonal prism-shaped cavity part 2*c*; and FIG. 4D shows a transverse cross-section of a rod-shaped cosmetic including a rod-shaped main body part 1*d* having a hexagonal prism-shaped external form and a hexagonal prism-shaped cavity part 2*d*.

With regard to the rod-shaped cosmetic according to the first embodiment, when the external form in the transverse cross-section of the rod-shaped main body part is a circle, the diameter thereof may be in a range similar to that of the above-mentioned $D_1$, from a similar viewpoint. When the external form in the transverse cross-section of the rod-shaped main body part is other than a circle, the maximum diameter may be in a range similar to that of the above-mentioned $D_1$, from a similar viewpoint.

With regard to the rod-shaped cosmetic according to the first embodiment, when the shape in the transverse cross-section of the cavity part is a circle, the diameter thereof may be in a range similar to that of the above-mentioned $D_2$, from a similar viewpoint. When the shape in the transverse cross-section of the cavity part is other than a circle, the maximum diameter thereof may be in a range similar to that of the above-mentioned $D_2$, from a similar viewpoint.

With regard to the rod-shaped cosmetic according to the first embodiment, the thickness of the rod-shaped main body part may be in a range similar to that of the thickness of the above-mentioned rod-shaped main body part 1, from a similar viewpoint.

With regard to the rod-shaped cosmetic according to the first embodiment, the ratio $S_1/S_2$ between the transverse cross-sectional area $S_1$ of the rod-shaped main body part and the transverse cross-section area $S_2$ of the cavity part may be in a range similar to that of the ratio $S_1/S_2$ for the above-mentioned rod-shaped main body part 1, from a similar viewpoint.

With regard to the rod-shaped cosmetic according to the first embodiment, the length of the rod-shaped main body part may be in a range similar to that of the length of the above-mentioned rod-shaped main body part 1, from a similar viewpoint.

Regarding the cosmetic composition constituting the rod-shaped main body part, a cosmetic composition including (A) an oily component (hereinafter, may be referred to as component (A)) and (B) a powder component (hereinafter, may be referred to as component (B)) may be mentioned.

Examples of the component (A) include waxes and other oil components. As the waxes, it is possible to use hardened oils such as hardened castor oil and hydrogenated soybean oil; solid paraffin, carnauba wax, candelilla wax, beeswax, Japan wax, ceresin, rice bran wax, synthetic hydrocarbon wax (synthetic wax), petrolatum, lanolin and lanolin derivatives, polymers such as an (acrylate/stearyl acrylate/dimethicone methacrylate) copolymer, and the like. Furthermore, as other oil components, higher fatty acids (the number of carbon atoms of the hydrocarbon group may be 16 to 22) such as stearic acid, oleic acid, myristic acid, palmitic acid, isostearic acid, behenic acid, linolic acid, and linoleic acid; hydrogenated polyisobutene (liquid isoparaffin), liquid paraffin, squalane, octyl dodecyl myristate, oleyl alcohol, octyl dodecanol, cetyl 2-ethylhexanoate, glyceryl tri-2-ethylhexanoate (triethylhexanoin), glyceryl tri(caprylate/caprate), trimethylolpropane trioctanoate, dipentaerythrityl hexa(hydroxystearate/stearate/rosinate), isocetyl stearate, diisostearyl malate, fatty acid (C18-36) glycol, sucrose tetrastearate triacetate, sorbitan sesquiisostearate, olive oil, methylpolysiloxane, trimethylsiloxysilicic acid, methyltrimethicone, methylphenyl polysiloxane (diphenylsiloxyphenyltrimethicone), decamethylcyclopentasiloxane, and the like can be used.

Regarding the component (A), one kind thereof can be used alone, or two or more kinds thereof can be used in combination.

The cosmetic composition may include one or more kinds of Japan wax, higher fatty acids, and hardened oils as the component (A), and in this case, the cosmetic composition is also suitable for extrusion molding.

The content of the component (A) in the cosmetic composition may be 10% to 90% by mass, may be 20% to 80% by mass, or may be 30% to 70% by mass, based on the total amount of the composition.

From the viewpoint of obtaining smooth application properties, the cosmetic composition may also include a volatile component as the component (A). In this case, smooth application properties and excellent usability such as that makeup can be applied without causing the eyebrows to lie down (without collapsing) can be achieved in a balanced manner. Incidentally, the volatile component according to the present specification means a component having a boiling point of 250° C. or lower at 1 atmosphere (101.325 kPa).

Examples of the volatile component include silicones such as dimethicone, methyltrimethicone, and methylphenyl polysiloxane; and oily components of hydrocarbons, such as isododecane, dodecane, (C9-12) alkanes, light isoparaffin, disiloxane, and trisiloxane.

The content of the volatile component (volatile oily component) in the cosmetic composition may be 0.5% to 40% by mass, may be 5% to 25% by mass, or may be 10% to 20% by mass, based on the total amount of the composition.

Examples of the component (B) include color materials such as a coloring pigment, and an extender pigment. Regarding such a pigment, it is possible to use mica, talc, sericite, silicic anhydride, barium sulfate, synthetic resin-based powder, organic pigments, inorganic pigments, pearl pigments, natural colors such as carmine, and the like.

Regarding the component (B), one kind thereof can be used alone, or two or more kinds thereof can be used in combination.

The content of the component (B) in the cosmetic composition may be 10% to 90% by mass, may be 20% to 80% by mass, or may be 30% to 70% by mass, based on the total amount of the composition.

In the cosmetic composition, an antiseptic agent, a surfactant, an antioxidant, a thickener, a whitening agent, a skin protecting agent, a skin softening agent, a skin soothing agent, an anti-inflammatory agent, a keratin protecting agent, and the like can be appropriately added in addition to the above-mentioned components, according to the purpose of use.

The rod-shaped cosmetic according to the first embodiment can be manufactured by, for example, the following procedure. First, a cosmetic composition is prepared by mixing the above-mentioned oily component, powder component, and optionally other components. Regarding the preparation method, for example, an oily component and optionally other components are mixed, the mixture is heated to melt, subsequently a powder component is mixed therein, and the resulting mixture may be uniformly dispersed with a three-roll machine or a stirrer. Next, the cosmetic composition can be melted and filled into a mold and solidified to obtain a rod-shaped cosmetic. Incidentally, solidification of the cosmetic composition can be carried out by standing to cool or by refrigeration. Furthermore, the rod-shaped cosmetic after molding may be heat-treated. When the cavity part is provided so as to reach both ends of the rod-shaped main body part, the rod-shaped cosmetic may be obtained by extrusion molding the cosmetic composition by using a hollow die or the like. Furthermore, as another method, a rod-shaped cosmetic may be fabricated by producing two rod-shaped cosmetics (for example, a rod-shaped cosmetic according to a third embodiment that will be described below) having shapes obtained by dividing an intended rod-shaped cosmetic and adhering these. The rod-shaped cosmetics having divided shapes can be fabricated by a method such as mold filling or extrusion molding. Examples of a method of adhering the rod-shaped cosmetics having divided shapes include compression and use of a paste.

In the case of using a mold, for example, a mold in which a core pin corresponding to the cavity part is installed can be used. According to such a mold, a rod-shaped cosmetic provided with a cavity part can be molded by pushing in a cosmetic composition, solidifying the cosmetic composition, and then pulling out the core pin. The mold temperature at the time of pulling out the core pin may be 25° C. or lower.

Second Embodiment

A rod-shaped cosmetic according to a second embodiment includes a rod-shaped main body part composed of a cosmetic composition, and a recessed part extending in the longitudinal direction of the rod-shaped main body part and opening in one direction perpendicular to the longitudinal direction (or, recessed in the inner side of the rod-shaped main body part) is provided on the side face of the rod-shaped main body part so as to reach one end or both ends of the rod-shaped main body part.

Figure 5:
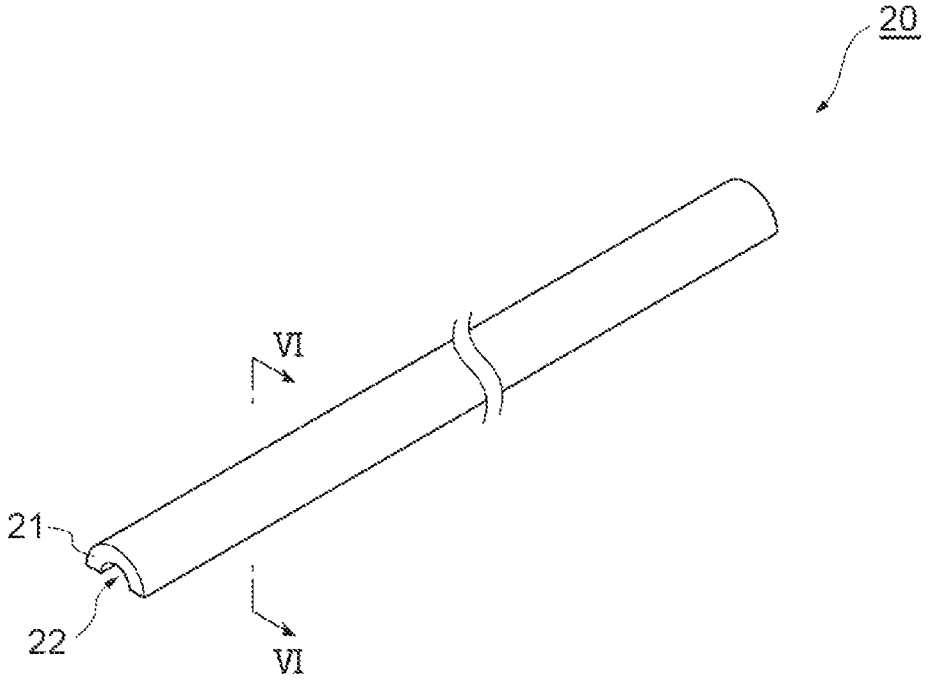
FIG. 5 is a perspective view showing an example of a rod-shaped cosmetic according to a second embodiment.

FIG. 5 is a perspective view showing an example of the rod-shaped cosmetic according to the second embodiment. The rod-shaped cosmetic 20 shown in FIG. 5 includes a rod-shaped main body part 21 composed of a cosmetic composition, and a recessed part 22 extending in the longitudinal direction of the rod-shaped main body part 21 and opening in one direction perpendicular to the longitudinal direction is provided on the side face of the rod-shaped main body part 21 so as to reach one end of the rod-shaped main body part.

Figure 6:
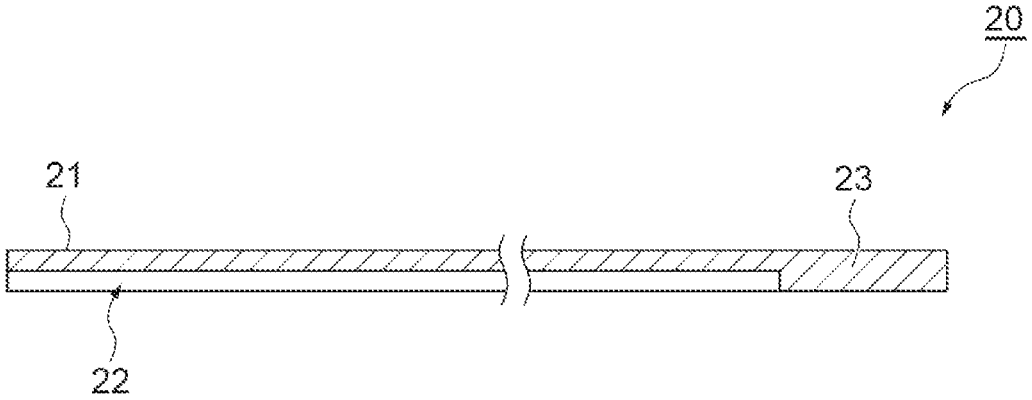
FIG. 6 is a cross-sectional view taken along line VI-VI in FIG. 5.

FIG. 6 is a cross-sectional view taken along line VI-VI in FIG. 5. As shown in FIG. 6, in the rod-shaped cosmetic 20, the rod-shaped main body part has an area 23 without the recessed part. This area 23 can be used as a holding part in which the rod-shaped cosmetic is held, for example, when the rod-shaped cosmetic is accommodated in a container having a feeding mechanism that continuously feeds out the rod-shaped cosmetic in the axial line direction. The length of the area 23 can be appropriately set according to the container accommodating the rod-shaped cosmetic; however, from the viewpoint of impact resistance, the length may be 5% to 40%, or may be 10% to 30%, with respect to the total length of the rod-shaped main body part. In the rod-shaped cosmetic 20, the length of the rod-shaped main body part 21 may be 15 to 100 mm, 20 to 50 mm, or 25 to 40 mm, from the viewpoints of portability and the number of times of use.

Figure 7:
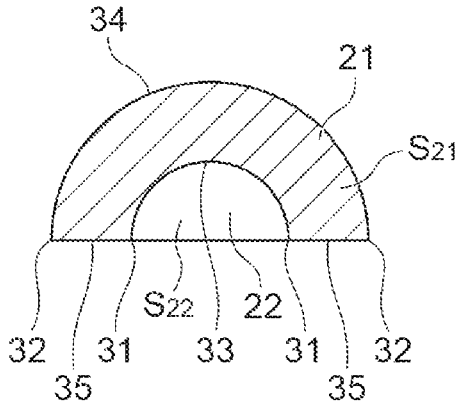
FIG. 7 is a diagram showing a transverse cross-section of the rod-shaped cosmetic shown in FIG. 5.

FIG. 7 is a diagram showing a transverse cross-section of the rod-shaped main body part 21 provided with the recessed part 22 in the rod-shaped cosmetic 20. In the rod-shaped cosmetic 20, the rod-shaped main body part 21 has a shape in which the recessed part 22 is provided on a flat side face of a rod-shaped object having a semicircular cylindrical shape, the inner face of the recessed part 22 in a cross-section orthogonally intersecting the longitudinal direction of the rod-shaped object has a semicircular shape, and as the centers of the semicircles overlap each other, the thickness of the rod-shaped main body part 21 can be made thin and constant. Incidentally, with regard to the rod-shaped cosmetics according to the second embodiment and a third embodiment that will be described below, the thickness of the rod-shaped main body part means the shortest distance connecting the inner face 33 of the recessed part and the side face 34 of the rod-shaped main body part facing this inner face.

The rod-shaped cosmetic 20 may also have the shape of one part obtainable when the above-mentioned rod-shaped cosmetic 10 is divided into two parts by means of a plane (e.g., a plane connecting reference character 32 shown in FIG. 7) that bisects the opening area of the cavity part 2 and is parallel to the longitudinal direction. With regard to the rod-shaped cosmetic according to the second embodiment, the above-described plane may pass through the center of the cavity part; however, the plane does not have to pass through the center of the cavity part.

Furthermore, with regard to the rod-shaped cosmetic according to the second embodiment, the thickness of the rod-shaped main body part does not have to be constant.

With regard to the sizes of the rod-shaped main body part 21 and the recessed part 22, the diameter of the semicircle in the rod-shaped object having a semicircular cylindrical shape can be set in the same range as that of the above-mentioned $D_1$, and the diameter of the semicircle in the recessed part having an inner face with a semicircular cylindrical shape can be set in the same range as that of the above-mentioned $D_2$.

The thickness of the rod-shaped main body part 21 can be set in the same range as the thickness of the above-mentioned rod-shaped main body part 1.

With regard to the rod-shaped cosmetic 20, from the viewpoint of the ease of shading, the ratio $S_{21}/S_{22}$ between the transverse cross-sectional area S21 of the rod-shaped main body part 21 and the transverse cross-sectional area S22 of a portion surrounded by the inner face 33 and a plane connecting both end parts 31 of the inner face in the recessed part 22, may be 0.5 to 3.5, 1.5 to 3.0, or 2.0 to 2.5.

With regard to the rod-shaped cosmetics according to the second embodiment and the third embodiment that will be described below, the external form of the rod-shaped main body part may be, as the shape of the transverse cross-section, a semicircle, a semi-ellipse, a semi-star shape, a semi-fan shape, a rectangle, or a polygon (having a number of corners of 5 or more), the shape of the inner face of the recessed part may be, as the shape of the transverse cross-section, a semicircle, a semi-ellipse, a semi-star shape, a semi-fan shape, a rectangle, or a polygon (having a number of corners of 5 or more), and these can be appropriately combined. Incidentally, the external form of the rod-shaped main body part refers to a shape connecting a plane connecting both end parts 31 of the inner face 33 in the recessed part and surfaces (surface 34 and surface 35) other than the inner face 33 of the recessed part in the side faces of the rod-shaped main body part, while the shape of the inner face of the recessed part refers to a shape connecting the inner face 33 in the recessed part and a plane connecting both end parts 31 of the inner face.

From the viewpoints of the ease of shading and impact resistance, the shapes of the external form of the rod-shaped main body part and the inner face of the recessed part may be, as the shape of each transverse cross-section, a semicircle or a polygon, and from the viewpoints of the ease of shading and usability, both of them may have the same shape (particularly, a semicircle or a polygon).

Figure 8A:
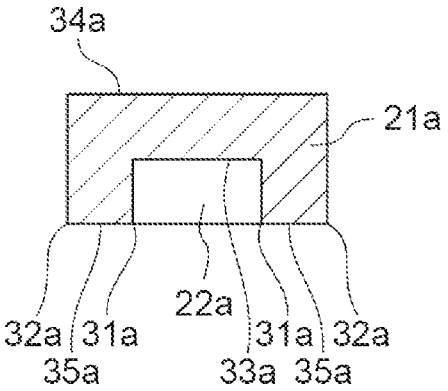
FIGS. 8A and 8B are diagrams showing transverse cross-sections of another example of the rod-shaped cosmetic according to the second embodiment.
Figure 8B:
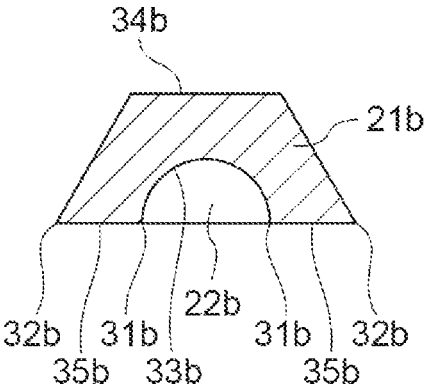

FIGS. 8A and 8B are diagrams showing transverse cross-sections of another example of the rod-shaped cosmetic according to the second embodiment. FIG. 8A shows a transverse cross-section of a rod-shaped cosmetic including a rod-shaped main body part 21*a* having an external form with a rectangular transverse cross-section and a recessed part 22*a* having an inner face shape with a rectangular transverse cross-section, and FIG. 8B shows a transverse cross-section of a rod-shaped cosmetic including a rod-shaped main body part 21*b* having an external form with a semi-hexagonal transverse cross-section and a recessed part 22*b* having an inner shape with a semicircular transverse cross-section.

With regard to the rod-shaped cosmetic according to the second embodiment, when the external form in the transverse cross-section of the rod-shaped main body part is a semicircle, the diameter thereof may be in a range similar to that of the above-mentioned $D_1$ from a similar viewpoint. When the external form in the transverse cross-section of the rod-shaped main body part is other than a semicircle, the maximum diameter thereof may be in a range similar to that of the above-mentioned $D_1$ from a similar viewpoint.

With regard to the rod-shaped cosmetic according to the second embodiment, when the inner face shape in the transverse cross-section of the recessed part is a semicircle, the diameter thereof may be in a range similar to that of the above-mentioned $D_2$ from a similar viewpoint. When the inner face shape in the transverse cross-section of the recessed part is other than a semicircle, the maximum diameter thereof may be in a range similar to that of the above-mentioned $D_2$ from a similar viewpoint.

With regard to the rod-shaped cosmetic according to the second embodiment, the thickness of the rod-shaped main body part is such that, from the viewpoints of the ease of manufacture and the breaking strength, the maximum thickness may be 0.5 to 6.0 mm, 1.0 to 4.0 mm, or 1.5 to mm, and from the viewpoints of mechanical strength and the ease of manufacture, the minimum thickness may be 0.5 to 6.0 mm, 1.0 to 4.0 mm, or 1.5 to 3.0 mm.

With regard to the rod-shaped cosmetic according to the second embodiment, from the viewpoints of usability and the ease of manufacture, the ratio $S_{21}/S_{22}$ between the transverse cross-sectional area S21 of the rod-shaped main body part and the transverse cross-sectional area S22 of a portion surrounded by the inner face and a plane connecting both end parts of the inner face in the recessed part may be 0.5 to 3.5, 1.5 to 3.0, or 2.0 to 2.5.

With regard to the rod-shaped cosmetic according to the second embodiment, from the viewpoint of impact resistance, the ratio T/I of the length I of the inner face of the recessed part with respect to the total length T of the outer periphery (also including the inner face of the recessed part) of the rod-shaped main body part in the transverse cross-section of the rod-shaped main body part provided with the recessed part may be 1.5 to 5.0, 2.0 to 4.5, or 2.5 to 4.0.

With regard to the rod-shaped cosmetic according to the second embodiment, from the viewpoint of impact resistance, the length of the rod-shaped main body part may be 15 to 100 mm, 20 to 50 mm, or 25 to 40 mm.

With regard to the rod-shaped cosmetic according to the second embodiment, the rod-shaped main body part can be composed of the above-mentioned cosmetic composition.

The rod-shaped cosmetic according to the second embodiment can be manufactured by, for example, the following procedure. First, a cosmetic composition is prepared by mixing the above-mentioned oily component, powder component, and optionally other components. Regarding the preparation method, for example, the oily component and optionally other components are mixed, the mixture is heated to melt, subsequently a powder component is mixed therein, and the resulting mixture may be uniformly dispersed with a three-roll machine or a stirrer. Next, the cosmetic composition can be melted and filled into a mold and solidified to obtain a rod-shaped cosmetic. When the recessed part is provided so as to reach both ends of the rod-shaped main body part, a rod-shaped cosmetic may be obtained by extrusion molding the cosmetic composition.

Solidification of the cosmetic composition can be carried out by standing to cool or by refrigeration. Furthermore, the rod-shaped cosmetic after molding may be heat-treated.

Third Embodiment

A rod-shaped cosmetic according to a third embodiment includes a rod-shaped main body part composed of a cosmetic composition, and the rod-shaped main body part has the shape of one part obtainable when a rod-shaped object in which a cavity part opening at one end or at both ends is provided to extend in the longitudinal direction, is divided into two parts by means of a plane that bisects the opening area and is parallel to the longitudinal direction.

According to the above-described rod-shaped cosmetic, usability and ease of drawing can become compatible with ease of shade adjustment, impact resistance, and strength. That is, the above-described rod-shaped main body part can have a recessed part extending in the longitudinal direction thereof, and in comparison with the case where such a recessed part is not provided, as the proportion of the transverse cross-sectional area (area serving as a surface of application) of the rod-shaped main body part with respect to the outer diameter (for example, maximum diameter) of the rod-shaped main body part becomes smaller and as the mechanical strength is increased by the side walls of the recessed part, while the mechanical strength is secured, the rod-shaped cosmetic can be smoothly applied while combing the eyebrows by means of a narrow surface of application, and in addition, since a moderate outer diameter can be secured, a moderate sensation of gradation can be rendered.

The above-described rod-shaped object can have a shape similar to that of the rod-shaped main body part in the above-mentioned rod-shaped cosmetic according to the first embodiment. The rod-shaped main body part can be composed of the above-mentioned cosmetic composition.

The rod-shaped cosmetic 20 shown in FIG. 5 is also an example of the rod-shaped cosmetic according to the third embodiment. That is, the rod-shaped cosmetic 20 has the shape of one part obtainable when the above-mentioned rod-shaped cosmetic 10 is divided into two parts by a plane that bisects the opening area of the cavity part 2 and is parallel to the longitudinal direction.

With regard to the rod-shaped cosmetic according to the third embodiment, the cavity part may be cylindrical-shaped. In this case, as the shape of the inner face of the recessed part has a semi-circular cylindrical shape, usability such as that makeup can be applied without causing the eyebrows to lie down (without collapsing) is likely to be obtained.

The rod-shaped cosmetic according to the third embodiment is also an aspect of the above-mentioned rod-shaped cosmetic according to the second embodiment and can be produced in the same manner as in the method for manufacturing the rod-shaped cosmetic according to the second embodiment.

The rod-shaped cosmetics according to the first embodiment, second embodiment, and third embodiment as described above are suitably used as eyebrow pencils, pencil eyeliners, eyeshadow sticks, and stick concealers. Furthermore, the rod-shaped cosmetics of the present embodiment can be used in pencil type cosmetic products that are used by continuously feeding out a rod-shaped cosmetic.

EXAMPLES

Hereinafter, the present invention will be described in more detail by way of Examples; however, the technical scope of the present invention is not intended to be limited by these Examples. Incidentally, the numerical values in the table indicate the contents (% by mass) based on the total amount of the cosmetic base material.

Prior to Examples, evaluation methods employed in each Example will be described.

<Evaluation of Ease of Drawing>

Five panels specialized in the evaluation of cosmetic products were asked to evaluate rod-shaped cosmetics charged into feed-type pencil containers as core materials, on whether the rod-shaped cosmetics could be smoothly applied when the rod-shaped cosmetics were applied while touching the top face or a side face of the core to the skin of the eyebrow portions. Incidentally, in the evaluation of the ease of drawing, a five-grade evaluation was performed according to the following evaluation criteria to assign a score to each sample, and the total points of the scores given by all the panels were determined according to the following criteria for determination.

[Score: Evaluation Criteria]

5 points: Very satisfactory
4 points: Satisfactory
3 points: Ordinary
2 points: Slightly defective
1 point: Defective

[Criteria for Determination (Total Point of Scores)]

A: 20 or more
B: 15 or more and less than 20
C: Less than 15

<Evaluation of Usability>

Five panels specialized in the evaluation of cosmetic products were asked to evaluate rod-shaped cosmetics charged into feed-type pencil containers as core materials, on whether the rod-shaped cosmetics could be applied without causing the eyebrows to lie down when the rod-shaped cosmetics were applied while touching the top face or a side face of the core to the skin of the eyebrow portions. Incidentally, in the evaluation of usability, a five-grade evaluation was performed according to the following evaluation criteria to assign a score to each sample, and the total points of the scores given by all the panels were determined according to the following criteria for determination.

[Score: Evaluation Criteria]

5 points: Very satisfactory
4 points: Satisfactory
3 points: Ordinary
2 points: Slightly defective
1 point: Defective

[Criteria for Determination (Total Point of Scores)]

A: 20 or more
B: 15 or more and less than 20
C: Less than 15

<Evaluation of Ease of Shade Adjustment>

Five panels specialized in the evaluation of cosmetic products were asked to evaluate rod-shaped cosmetics charged into feed-type pencil containers as core materials, on the ease of shade adjustment when the rod-shaped cosmetics were applied while touching the top face or a side face of the core to the skin of the eyebrow portions. Incidentally, in the evaluation of the ease of shade adjustment, a five-grade evaluation was performed according to the following evaluation criteria to assign a score to each sample, and the total points of the scores given by all the panels were determined according to the following criteria for determination.

[Score: Evaluation Criteria]

5 points: Very satisfactory
4 points: Satisfactory
3 points: Ordinary
2 points: Slightly defective
1 point: Defective

[Criteria for Determination (Total Point of Scores)]

A: 20 or more
B: 15 or more and less than 20
C: Less than 15

<Evaluation of Impact Resistance>

A molded rod-shaped cosmetic was mounted into a feed-type pencil container and left to stand for 24 hours at 25° C., and then the container was repeatedly subjected to flat dropping from a height of 70 cm. After each dropping, the appearance of the rod-shaped cosmetic after dropping was checked by visual inspection, and impact resistance was evaluated according to the following evaluation criteria.

[Evaluation Criteria]

A: Even after performing flat dropping for five times, breaking, or bending that disabled feeding out from the container was not observed.

C: After performing flat dropping for one to four times, breaking, or bending that disabled feeding out from the container was observed.

<Measurement of Breaking Strength>

For a molded rod-shaped cosmetic, the breakage load when a load was applied at a rate of 2 mm/min at the center of the rod-shaped cosmetic supported with a distance between supporting points of 20 mm was measured at 25° C. by using a rheometer (manufactured by Fudoh Kogyo Co., Ltd.). Measurement was made at N=5, and an average value thereof was determined.

<Production of Rod-Shaped Cosmetic>

Examples 1 and 2 and Comparative Examples 1 to 3

A mixture obtained by heating and melting the following component 1 to component 8 at 95° C. to 105° C. was mixed with component 9 and component 10, and the resulting mixture was uniformly dispersed by using a three-roll. To this dispersion, components 11 and 12 were further mixed, and the mixture was dispersed to prepare a cosmetic composition having the following composition (% by mass).

| (Component) | (Blending proportion (% by mass)) |
|---|---|
| 1. Synthetic wax | 8 |
| 2. Carnauba wax | 3 |
| 3. Fatty acid (C18-36) glycol | 3 |
| 4. (Acrylate/stearyl acrylate/dimethicone methacrylate) copolymer | 1 |
| 5. Hydrogenated polyisobutene | 1 |
| 6. Diisostearyl malate | 2 |
| 7. Diphenylsiloxyphenyltrimethicone | 3 |

-continued

| (Component) | (Blending proportion (% by mass)) |
|---|---|
| 8. Antioxidant | 0.04 |
| 9. Color material | 12.9 |
| 10. Extender pigment | 25 |
| 11. Trimethylsiloxysilicic acid | 21 |
| 12. Methyltrimethicone | 20.06 |

Next, the cosmetic composition was filled into a predetermined mold in which a core pin was installed, the cosmetic composition was solidified, and then the core pin was pulled out to mold a rod-shaped cosmetic including a main body part having the external form shown in Table 1 and a cavity part having the inner face shape shown in Table 1. Incidentally, the cavity part was provided so as to extend over the entire length (34.5 mm) of the main body part (such that both ends of the main body part were opened).

TABLE 1

| | | Example 1 | Example 2 | Comparative Example 1 | Comparative Example 2 | Comparative Example 3 |
|---|---|---|---|---|---|---|
| Main body part | External form | Cylindrical shape | Cylindrical shape | Cylindrical shape | Cylindrical shape | Cylindrical shape |
| | Diameter (mm) | 2 | 3 | 2 | 3 | 1 |
| Cavity part | Inner face shape | Cylindrical shape | Cylindrical shape | — | — | — |
| | Diameter (mm) | 1.0 | 2.0 | — | — | — |
| Evaluation | Ease of drawing | A | A | B | B | A |
| | Usability | A | A | C | C | A |
| | Ease of shade adjustment | B | A | C | C | C |
| | Impact resistance | A | A | A | A | C |
| | Breaking strength (N) | 0.32 | 1.00 | 0.32 | 1.19 | 0.10 |

Example 3

A mixture obtained by heating and melting the following component 1 to component 8 at 95° C. to 105° C. was mixed with component 10 and component 11, and the resulting mixture was uniformly dispersed by using a three-roll to prepare a cosmetic composition having the following composition (% by mass).

| (Component) | (Blending proportion (% by mass)) |
|---|---|
| 1. Behenic acid | 15 |
| 2. Japan wax | 8 |
| 3. Hydrogenated castor oil | 4 |
| 4. Sucrose tetrastearate triacetate | 5 |
| 5. Dipentaerythrityl hexa(hydroxystearate/stearate/rosinate) | 5 |
| 6. Triethylhexanoin | 5 |
| 7. Glyceryl tri(caprylate/caprate) | 2 |
| 8. Sorbitan sesquiisostearate | 1 |
| 9. Antioxidant | 0.04 |
| 10. Color material | 24.96 |
| 11. Extender pigment | 30 |

Next, the cosmetic composition was extrusion molded by using a hollow die to mold a rod-shaped cosmetic including a main body part having a cylindrical-shaped external form (diameter: 3 mm) and a cavity part having a cylindrical-shaped inner face shape (diameter: 2.0 mm) Incidentally, the cavity part was prepared so as to extend over the entire length (34.5 mm) of the main body part (such that both ends of the main body part were opened).

<Evaluation>

The obtained rod-shaped cosmetic was evaluated in the same manner as described above, and the ease of drawing was rated as "B", usability was rated as "A", the ease of shade adjustment was rated as "A", the impact resistance was rated as "A", and the breaking strength was 2.00 N.

REFERENCE SIGNS LIST

1, 21: rod-shaped main body part, 2: cavity part, 3: area without cavity part, 10, 20: rod-shaped cosmetic, 22: recessed part, 23: area without recessed part.

What is claimed is:

1. A rod-shaped cosmetic, comprising:

a rod-shaped main body part having a first terminal end and a second terminal end, wherein the rod-shaped main body part has a constant outer cross-section from the first terminal end to the second terminal end and is composed of a cosmetic composition, wherein a cavity part is provided inside the rod-shaped main body part and extends in a longitudinal direction of the rod-shaped main body part such that the cavity part extends through at least one end of the rod-shaped main body part, and wherein the cavity part extends at least to a longitudinal center of the rod-shaped cosmetic and is unfilled with cosmetic material.

2. The rod-shaped cosmetic according to claim 1, wherein the cosmetic composition includes a volatile component.

3. The rod-shaped cosmetic according to claim 1, wherein the cavity part has a cylindrical shape.

4. The rod-shaped cosmetic according to claim 1, wherein a ratio S1/S2 between a transverse cross-sectional area S1 of the rod-shaped main body part and a transverse cross-sectional area S2 of the cavity part is 0.5 to 3.5.

5. The rod-shaped cosmetic according to claim 1, wherein the rod-shaped main body part has an area without the cavity part, and a length of the area is 5% to 40% with respect to an entire length of the rod-shaped main body part.

6. The rod-shaped cosmetic according to claim 1, wherein an external form in a transverse cross-section of the rod-shaped main body part has a maximum diameter of 2.0 to 3.0 mm.

7. The rod-shaped cosmetic according to claim 1, wherein the rod-shaped cosmetic is an eyebrow pencil, a pencil eyeliner, an eyeshadow stick, or a stick concealer.

8. A rod-shaped cosmetic, comprising:

a rod-shaped main body part composed of a cosmetic composition, wherein a recessed part has a first terminal end and a second terminal end, wherein the recessed part has a constant cross-section from the first terminal end to the second terminal end and is provided on a side face of the rod-shaped main body part and extends in a longitudinal direction of the rod-shaped main body part such that the recess part opens in a direction perpendicular to the longitudinal direction, wherein the recessed part reaches at least one end of the rod-shaped main body part and wherein the recessed part extends at least to a longitudinal center of the rod-shaped cosmetic and is unfilled with cosmetic material.

9. The rod-shaped cosmetic according to claim 8, wherein the cosmetic composition includes a volatile component.

10. The rod-shaped cosmetic according to claim 8, wherein a ratio S21/S22 between a transverse cross-sectional area S21 of the rod-shaped main body part and a transverse cross-sectional area S22 of a portion surrounded by an inner face of the recessed part and a plane connecting opposing end parts of the inner face in the recessed part is 0.5 to 3.5.

11. The rod-shaped cosmetic according to claim 8, wherein the rod-shaped main body part has an area without the recessed part, and a length of the area is 5% to 40% with respect to an entire length of the rod-shaped main body part.

12. The rod-shaped cosmetic according to claim 8, wherein an external form in a transverse cross-section of the rod-shaped main body part has a maximum diameter of 2.0 to 3.0 mm.

13. The rod-shaped cosmetic according to claim 8, wherein the rod-shaped cosmetic is an eyebrow pencil, a pencil eyeliner, an eyeshadow stick, or a stick concealer.

14. A rod-shaped cosmetic, comprising:

a rod-shaped main body part composed of a cosmetic composition, wherein a recessed part extending in a longitudinal direction of the rod-shaped main body part and opening in one direction perpendicular to the longitudinal direction is provided on a side face of the rod-shaped main body part so as to reach one end or both ends of the rod-shaped main body part, wherein the rod-shaped main body part has a shape in which the recessed part is provided on a flat side face of a semicircular cylindrical-shaped rod-shaped object, and an inner face of the recessed part in a cross-section orthogonally intersecting a longitudinal direction of the rod-shaped object has a semicircular shape.

15. The rod-shaped cosmetic according to claim 14, wherein the cosmetic composition includes a volatile component.

16. The rod-shaped cosmetic according to claim 14, wherein a ratio S21/S22 between a transverse cross-sectional area S21 of the rod-shaped main body part and a transverse cross-sectional area S22 of a portion surrounded by an inner face of the recessed part and a plane connecting opposing end parts of the inner face in the recessed part is 0.5 to 3.5.

17. The rod-shaped cosmetic according to claim 14, wherein the rod-shaped main body part has an area without the recessed part, and a length of the area is 5% to 40% with respect to an entire length of the rod-shaped main body part.

18. The rod-shaped cosmetic according to claim 14, wherein an external form in a transverse cross-section of the rod-shaped main body part has a maximum diameter of 2.0 to 3.0 mm.

19. The rod-shaped cosmetic according to claim 14, wherein the rod-shaped cosmetic is an eyebrow pencil, a pencil eyeliner, an eyeshadow stick, or a stick concealer.

* * * * *